United States Patent [19]

Repp

[11] 4,249,715

[45] Feb. 10, 1981

[54] SIGN APPARATUS

[76] Inventor: Garry E. Repp, 2605 Maple, Norfolk, Nebr. 68701

[21] Appl. No.: 59,455

[22] Filed: Jul. 20, 1979

[51] Int. Cl.[3] ..... F16M 13/00

[52] U.S. Cl. ..... 248/545; 40/607; 248/156

[58] Field of Search ..... 248/545, 121, 122, 124, 248/125, 166, 165, 169, 159, 156; 40/606, 607; 292/106

[56] References Cited

U.S. PATENT DOCUMENTS

| | | | |
|---|---|---|---|
| 879,052 | 2/1908 | Jeranek | 248/156 X |
| 1,260,537 | 3/1918 | Hasselbach | 211/48 X |
| 1,403,865 | 1/1922 | Pritchett | 248/121 X |
| 2,409,076 | 10/1946 | Steinberger et al. | 40/607 |
| 2,559,302 | 7/1951 | Louft | 40/607 |
| 2,663,585 | 12/1953 | Tye | 292/106 |
| 3,143,817 | 8/1964 | Paulson | 248/156 X |
| 3,285,554 | 11/1966 | Voelkerding | 248/121 |
| 3,318,560 | 5/1967 | Garrette et al. | 248/156 X |
| 3,519,234 | 7/1970 | Matson | 248/156 |
| 3,804,355 | 4/1974 | Uroshevich | 248/125 |

*Primary Examiner*—J. Franklin Foss
*Attorney, Agent, or Firm*—Henderson & Sturm

[57] ABSTRACT

Sign mounting apparatus including a tubular post member is adapted to be mounted in a vertically oriented position. A horizontal member is attached to the post member and a mechanism is provided for removeably attaching the horizontal member to the tubular post member. Loops are on the horizontal member for attaching a sign to the horizontal member. A post driving mechanism is attached to the post member for securing the post to the ground by reciprocal movement of the post member and includes a closure member secured to the bottom end of the tubular post member and having a central opening therein, a shaft reciprocally mounted in the opening and moveable between a first position extending a substantial distance into the tubular post member and a second position substantially outside of the tubular post member, a first stop member on an upper end of the shaft for preventing the shaft from dropping downwardly out of the opening, a second stop member secured to a central portion of the shaft for preventing the shaft from entering the opening beyond the second stop member and a locking mechanism for holding the shaft in the first position thereof whereby it cannot slide to the second position thereof, thereby rendering it safe to carry from place to place.

13 Claims, 5 Drawing Figures

4.
4.

SIGN APPARATUS

BACKGROUND OF THE INVENTION

The present invention relates generally to signs and more particularly to a sign apparatus having a driving mechanism attached thereto for securing a sign to the ground.

One of the most time consuming problems involved with erecting signs is the process of securing of such sign to the ground. Certain types of driving mechanisms have been devised for driving a stake portion into the ground, which stake portion is attached to the bottom of an upright member. An example of such a driving mechanism for a sign is shown in U.S. Pat. No. 3,143,817, for example. One of the problems with this type of a driving mechanism is that it is cumbersome; and, furthermore, it is not entirely safe. The safety problem arises when such a device is carried and a freely reciprocating shaft member with a pointed end thereon can slide out of a sleeve and injure a person if it happens to be tilted so that the shaft points downwardly to some degree at least. There is consequently a need for safety devices for solving this problem.

One common type of sign is one which has a vertically upstanding post member and a horizontal cross member attached thereto for hanging a sign thereon. One of the major problems with this type of a sign mounting apparatus is that it is extremely cumbersome and takes up a great deal of room in the trunk of a car or other hauling vehicle; and, sometimes, is even of a size which prohibits it from being transported from place to place in normal size automobiles. Consequently, there is a need for this type of sign mounting apparatus which can be readily broken down and made more compact for transporting from place to place, but still being readily and quickly reassembled for use.

SUMMARY OF THE INVENTION

The present invention relates to a sign mounting apparatus including a tubular post member adapted to be mounted in a vertically oriented position. A horizontal member is attached to the post member and mechanism is provided for removeably attaching the horizontal member to the tubular post member. Loops are on the horizontal member for attaching a sign to the horizontal member. A post driving mechanism is attached to the post member for securing the post to the ground by reciprocal movement of said post member and includes a closure member secured to the bottom end of the tubular post member and having a central opening therein, a shaft reciprocally mounted in the opening and moveable between a first position extending a substantial distance into the tubular post member and a second position substantially outside of the tubular post member, a first stop member on an upper end of the shaft for preventing the shaft from dropping downwardly out of the opening, a second stop member secured to a central portion of the shaft for preventing the shaft from entering the opening beyond the second stop member and a locking mechanism for holding the shaft in the first position thereof whereby it cannot slide to the second position thereof, thereby rendering it safe to carry from place to place.

An object of the present invention is to provide an improved sign mounting apparatus.

Another object of the invention is to provide a sign mounting apparatus of the type having a vertical post and a horizontal post attached thereto and a driving mechanism for quickly attaching such sign mounting apparatus to the ground.

A further object of the invention is to provide such a sign mounting apparatus which is readily disassembled for shipping or transporting from place to place while still facilitating quick assembly and use.

A further object of the invention is to provide a sign mounting apparatus of the general type characterized above which is safe to use.

Still another object of the invention is to provide a sign mounting apparatus of the general type characterized above which is simple and economical to use and is yet dependable and durable.

Other objects, advantages and novel features of the invention will become apparent from the following detailed description of the invention when considered in conjunction with the accompanying drawings.

DESCRIPTION OF THE PREFERRED EMBODIMENT

Figures 1, 2, 3, 4, 5:
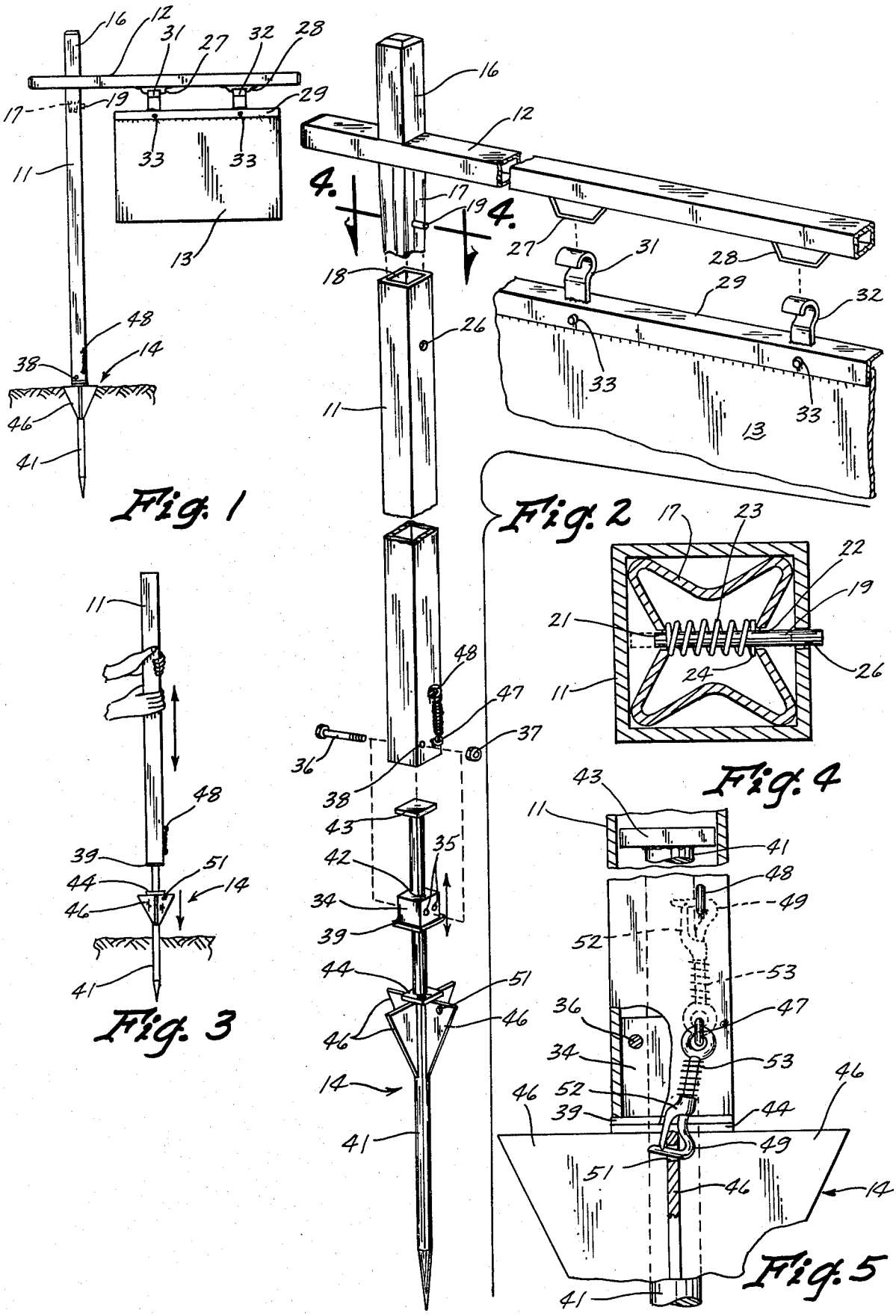
FIG. 1 is a side elevational view of a preferred embodiment of the present invention.
FIG. 2 is an enlarged exploded perspective view of the sign mounting apparatus shown in FIG. 1.
FIG. 3 is a side elevational view showing the process of attaching the sign into the ground.
FIG. 4 is a cross-sectional view taken along line 4—4 of FIG. 2.
FIG. 5 is an enlarged view of the locking safety mechanism of the present invention, with portions thereof broken away in cross section.

Referring now to the drawings where in like reference numerals designate identical or corresponding parts throughout the several views, FIG. 1 shows a sign mounting apparatus 10 constructed in accordance with the present invention. A tubular post member 11 is generally disposed in a vertical fashion in the installed position of the sign. A horizontal cross member 12 is attached to the top of the post member 11 and a sign, such as a real estate sign 13 is attached to the horizontal member 12. An earth engaging driving mechanism 14 is attached to the lower portion of the post member 11 as will be explained in detail below.

Referring now to FIG. 2, it is noted that the horizontal member 12 has a decorative upstanding portion 16 attached thereto, such as by welding, and a lower member 17 which is formed by crimping each side of a normal piece of tubing, like the member 16, such that the member 17 will be small enough to fit into the upper end 18 of the post member 11. A pin member 19 is disposed through openings 21 and 22 in the member 17, as can best be seen in FIG. 4. A compression spring 23 is disposed around the pin 19 and against the metal surrounding opening 21. A smaller pin 24 extends through the larger pin 19 as can be seen in FIG. 4, and the compression spring 23 pushes on the smaller pin 24, thereby biasing the larger pin 19 to the right-most position, shown in solid lines in FIG. 4 and 2.

When it is desired to place the horizontal beam 12 and its associated structure to the vertical post 11, then the rightmost end of the pin 19, as viewed in FIG. 2, is pushed inwardly and the member 17 pushed downwardly into telescoping relationship with the top portion of the post 11. This structure must be so oriented such that the pin 19 is on the same side as an opening 26 in the top portion of the post 11. Once the member 17 is received downwardly into the post 11 far enough, then the pin 19 will snap into the opening 26 as shown in FIG. 4 in solid lines whereby the horizontal beam 12 is held in the position shown in FIG. 1.

A pair of loops 27 and 28 are attached to the bottom of the horizontal beam 12, for example by welding, for the purpose of hanging a sign 13 thereon. The sign 13 is bolted to an angle iron structure 29 and hooks 31 and 32 are welded to the angle iron structure 29. The use of the term "angle iron" is used because of the well known shape described by such term but this structure could, of course, be made of materials and metals other than iron. Fastening members 33 are provided for attaching the sign 13 to the angle iron 29 and hooks 31 and 32. These hooks 31 and 32 are then used to hang the sign 13 on the loops 27 and 28, for example as shown in FIG. 1.

Referring now with more particularity to the structure 14 for attaching the sign mounting apparatus to the ground, it is noted that a closure member 34 is provided for being mounted by one or more bolt and nut structures 36 and 37 respectively. It has actually been determined that at least two such fastening structures are preferred. This closure member 34 is sized to slide into the bottom of the tubular post member 11 and openings 38 are provided through the post member 11 for receiving the bolts 36. Openings 38 in the closure member 34 are also provided for receiving the bolts 36. A plate 39 is attached to the bottom of closure member 34, such as by welding, for the purpose of providing a stop so that the member 34 does not go too far up into the post 11, as can be clearly seen in FIG. 5. A shaft 41 extends through an opening 42 in the closure member 34, whereby the shaft 41 can reciprocate through the opening 42. A first stop member 43 is welded to the top of the shaft 41 and a second stop member 44 is welded to an intermediate portion of the shaft 41. Fins 46 are provided for preventing the shaft 41 from rotating while in the ground. Additionally the square shape of the stop member 43 that slides in close tolerance within the inside of the post member 11 prevents the post member 11 from turning with respect to the shaft 41. Consequently, the sign will generally stay in the position wherein it is placed and will not rotate about the axis of the shaft 41.

A loop 47 is attached to the bottom portion of the post 11 and a loop 48 is attached also to the post 11 above the loop 47. A hook 49 is pivotally attached to the loop 47 and the hook 49 can be hooked alternatively into an opening 51 in one of the fins 46 or into the loop 48 as desired. A guard structure 52 is biased into position shown in FIG. 5 with respect to the hook 49 by means of a compression spring 53. If it is desired to move the hook 49 from the position shown in solid lines in FIG. 5 to the position shown in dashed lines in FIG. 5, then the member 52 is reciprocated upwardly, overcoming the bias on the spring 53, and then the hook 49 is removed from the opening 51. Then, keeping the member 52 biased closer to the loop 47, the hook 49 can then be inserted into the loop 48 and the member 52 released to assume the position shown whereby the hook 49 will not be moved from the loop 48 until such event is desired.

In operation, the device would generally be disassembled and might, for example, be transported to the place of use in the trunk of a car in such condition. The parts are then removed and the structure 14 connected to the post member 11. The hook 49 would be placed in the upward position as shown in FIG. 3; and, as shown in dashed lines in FIG. 5. The post member 11 would then be grasped as shown in FIG. 3 and moved to an upward position until the stop 43 would be on the top of the member 34. At such time, then downward pressure is transmitted to the post 11, whereby the member 39 will strike the member 44 in a very forceful fashion to drive the shaft 41 into the ground. This procedure is repeated until the shaft 41 is driven to the position shown with respect to the ground in FIG. 1. Once this has been done, then the horizontal member 12 will be placed onto the top of the post member 11 according to the procedure described above, and the sign 13 attached to the loops 27 and 28, also according to the procedure outlined above in detail.

When it is desired to remove the sign from the premises, (for example if the sign were being used for real estate purposes, then after the property has passed to the new owners by sale) then the button 19 would be pushed from the position shown in FIG. 4 in solid lines to the position shown in dashed lines in FIG. 4 and the member 17 pulled upwardly and out of the top of the member 11. The sign 13 could be removed from the horizontal member 12 before or after the horizontal portion 12 is so removed from the post member 11.

To remove the shaft 41 from the ground it is preferred to first remove the horizontal member. Then, with hook 49 still in the up position, grasping the post 11, the post 11 is pulled up sharply whereby the member 34 strikes the top of member 43, thereby driving shaft 41 upwardly. This procedure is repeated until the shaft 41 is driven out of the ground.

An important safety feature is also accomplished when this hook 49 is left in the position shown in solid lines in FIG. 5 while transporting the device from place to place. If, for example, while carrying the post 11 with the driver shaft 41 therein and there was no hook 49, if the person holding the post 11 tilts it downwardly to any extent, the shaft 41 can quickly drop out of the post 11 rather unexpectedly; and, a person in the way of such shaft 41 can be severely injured thereby. Consequently, the hook 49 is left in the position shown in solid lines in FIG. 5 until such time that the driving procedure shown in FIG. 3 and explained above is required to be accomplished again.

Accordingly it is believed that all the objects mentioned above are accomplished by use of the preferred embodiment disclosed herein. Obviously many modifications and variations of the present invention are possible in light of the above teachings. It is, therefore, to be understood that, within the scope of the appended claims, the invention may be practiced otherwise than specifically described.

I claim:

1. Sign mounting apparatus comprising:

a tubular post member adapted to be mounted in a vertically oriented position;

a horizontal member;

means for removably attaching said horizontal member to said tubular post member;

means for attaching a sign to said horizontal member; and post driving means for securing said post to the ground by reciprocal movement of said post member comprising:

a closure member secured to the bottom end of said tubular post member and having a central opening therein;

a shaft reciprocally mounted in said opening and movable between a first position extending a substantial distance into said tubular post member and a second position substantially outside of said tubular post member;

a first stop means on an upper end of said shaft for preventing said shaft from dropping downwardly out of said opening;

a second stop means secured to a central portion of said shaft for preventing said shaft from entering said opening beyond the second stop means; and means for preventing said post member from rotating with respect to said shaft, said rotation prevention means comprising a non-circular cross sectional shape on said tubular post member and a complementary non-circular shape on said first stop means, said first stop means being slideably disposed within said tubular post member.

2. Sign mounting apparatus as defined in claim 1 wherein said post driving means includes:

locking means for holding said shaft in said first position thereof whereby it cannot slide to said second position thereof, thereby rendering it safe to carry from place to place.

3. Sign mounting apparatus as defined in claim 1 including a plurality of radially extending fins secured to said shaft.

4. Sign mounting apparatus as defined in claim 3 whereby said locking means comprises a hook member pivotally attached at one end thereof to said post member and an opening being disposed in one of said fins for reception of the other end of said hook member.

5. Sign mounting apparatus as defined in claim 4 whereby said locking means further comprises a safety member reciprocally attached to said hook member and means for biasing said safety member to a position preventing said hook member from inadvertantly moving out of said opening, said safety member being moveable by overcoming the safety member biasing means whereby the hook member can be removed from said opening.

6. Sign mounting apparatus as defined in claim 5 including loop means attached to said post member for holding said hook means out of the way when the post member is being secured into the ground.

7. Sign mounting apparatus as defined in claim 6 including means for removeably attaching said closure member to the end of said tubular post member whereby the shaft and the structure connected thereto can be removed from the post member for making the apparatus more compact for shipping and transporting purposes.

8. Sign mounting apparatus as defined in claim 1 wherein said rotation prevention means comprises a square cross-sectional shape to said tubular post member and wherein said first stop means is substantially square in shape.

9. Sign mounting apparatus as defined in claim 1 wherein said sign mounting means comprises a pair of loops attached to said horizontal member, an angle iron, a pair of hooks attached to said angle iron for reception into said loops and a sign attached to said angle iron whereby said sign will be reinforced from bending by said angle iron.

10. Sign mounting apparatus as defined in claim 1 wherein said means for removeably attaching the horizontal member to the tubular post member comprises a vertically disposed member attached to said horizontal member for reception into the top of the tubular post member, a hole extending horizontally through the vertically disposed member, a horizontally disposed pin reciprocally disposed within said hole, means for biasing said pin to a first outward position with respect to said vertically disposed member, said pin being moveable to a second inward position in response to overcoming the biasing means on the pin, and an opening in a sidewall of the tubular post member for reception of said pin, whereby when the pin is in the first outward position in the opening in the sidewall of the tubular post member, said horizontal member is held in proper sign dsplaying position with respect to the tubular post member.

11. Sign mounting apparatus as defined in claim 1 wherein said closure member is of a complementary shape with respect to the cross-sectional shape of the inside of the tubular post member; and a stop means is attached to the bottom of the closure member for establishing the proper relative position of the closure member with respect to the tubular post member.

12. Sign mounting apparatus comprising:

a tubular post member adapted to be mounted in a vertically oriented position;

a horizontal member;

means for removably attaching said horizontal member to said tubular post member;

means for attaching a sign to said horizontal member; and post driving means for securing said post to the ground by reciprocal movement of said post member comprising:

a closure member secured to the bottom end of said tubular post member and having a central opening therein;

a shaft reciprocally mounted in said opening and movable between a first position extending a substantial distance into said tubular post member and a second position substantially outside of said tubular post member;

a first stop means on an upper end of said shaft for preventing said shaft from dropping downwardly out of said opening;

a second stop means secured to a central portion of said shaft for preventing said shaft from entering said opening beyond the second stop means;

a plurality of radially extending fins secured to said shaft; and locking means for holding said shaft in said first position thereof whereby it cannot slide to said second position thereof, thereby rendering it safe to carry from place to place, said locking means comprising a hook member pivotally attached at one end thereof to said post member and an opening being disposed in one of said fins for reception of the other end of said hook member.

13. Sign mounting apparatus comprising:

a tubular post member adapted to be mounted in a vertically oriented position;

a horizontal member;

means for removably attaching said horizontal member to said tubular post member, said means for removably attaching the horizontal member to the tubular post member comprising a vertically disposed member attached to said horizontal member for reception into the top of the tubular post member, said vertically disposed member being generally square in cross-sectional shape at the top thereof and the sides of the square shape being bent radially inwardly near the bottom thereof, a hole extending horizontally through the vertically disposed member, a horizontally disposed pin reciprocally disposed within said hole, means for biasing said pin to a first outward position with respect to said vertically disposed member, said pin being movable to a second inward position in response to overcoming the biasing means on the pin, and an opening in a sidewall of the tubular post member for reception of said pin, whereby when the pin is in the first outward position in the opening in the sidewall of the tubular post member, said horizontal member is held in proper sign displaying position with respect to the tubular post member;

means for attaching a sign to said horizontal member; and post driving means for securing said post to the ground by reciprocal movement of said post member comprising:

a closure member secured to the bottom end of said tubular post member and having a central opening therein;

a shaft reciprocally mounted in said opening and movable between a first position extending a substantial distance into said tubular post member and a second position substantially outside of said tubular post member;

a first stop means on an upper end of said shaft for preventing said shaft from dropping downwardly out of said opening; and a second stop means secured to a central portion of said shaft for preventing said shaft from entering said opening beyond the second stop means.

* * * * *